US007786413B2

(12) United States Patent
Itou et al.

(10) Patent No.: US 7,786,413 B2
(45) Date of Patent: Aug. 31, 2010

(54) HEATING COOKER

(75) Inventors: Tadaaki Itou, Hyogo (JP); Masamichi Komada, Hyogo (JP)

(73) Assignee: Panasonic Corporation, Osaka (JP)

( * ) Notice: Subject to any disclaimer, the term of this patent is extended or adjusted under 35 U.S.C. 154(b) by 243 days.

(21) Appl. No.: 11/995,840

(22) PCT Filed: Sep. 7, 2006

(86) PCT No.: PCT/JP2006/317727

§ 371 (c)(1),
(2), (4) Date: Jan. 16, 2008

(87) PCT Pub. No.: WO2007/032247

PCT Pub. Date: Mar. 22, 2007

(65) Prior Publication Data

US 2009/0127248 A1 May 21, 2009

(30) Foreign Application Priority Data

Sep. 16, 2005 (JP) ..... 2005-269617

(51) Int. Cl.
*H05B 1/02* (2006.01)

(52) U.S. Cl. ..... 219/489; 219/492; 219/506; 219/448.11

(58) Field of Classification Search ..... 219/492, 219/494, 497, 501, 506, 702, 710, 448.11, 219/443.1, 481
See application file for complete search history.

(56) References Cited

U.S. PATENT DOCUMENTS

| | | | | | |
|---|---|---|---|---|---|
| 4,234,784 | A | * | 11/1980 | Totterdell | 219/506 |
| 4,572,935 | A | * | 2/1986 | Karino | 219/710 |
| 4,902,878 | A | * | 2/1990 | Smith et al. | 219/486 |
| 5,416,301 | A | * | 5/1995 | Aoshima | 219/506 |
| 2003/0066827 | A1 | * | 4/2003 | Daum et al. | 219/492 |

FOREIGN PATENT DOCUMENTS

| | | | |
|---|---|---|---|
| JP | 61-159912 | A | 7/1986 |
| JP | 11-132470 | A | 5/1999 |
| JP | 3264235 | B | 12/2001 |
| JP | 2003-279055 | A | 10/2003 |

OTHER PUBLICATIONS

International Search Report for Application No. PCT/JP2006/317727 dated Dec. 12, 2006.

* cited by examiner

*Primary Examiner*—Mark H Paschall
(74) *Attorney, Agent, or Firm*—RatnerPrestia

(57) ABSTRACT

When a timer period reaches an increase-stopping-time during the long-push state of a timer key, increase of the timer period is stopped once. Accordingly, even though a long-push state is continued due to a fault of the timer key, the indication of the timer period is not repeated.

10 Claims, 10 Drawing Sheets

HEATING COOKER

THIS APPLICATION IS A U.S. NATIONAL PHASE APPLICATION OF PCT INTERNATIONAL APPLICATION PCT/JP2006/317727.

TECHNICAL FIELD

The present invention relates to a heating cooker that is used at a home kitchen or a commercial kitchen.

BACKGROUND ART

A heating cooker where a timer period is increased whenever a timer key is pushed has been disclosed in Japanese Patent No. 3264235.

The heating cooker in the conventional art will be described with reference to FIGS. 8 to 10. FIG. 8 is a block diagram showing the structure of a heating cooker in the conventional art. FIG. 9 is a flowchart illustrating the operation when the long-push of a timer key in the conventional art is continued. FIG. 10 is a view showing indication examples of a timer period indicator.

In FIG. 8, a heating device 2 includes a heating coil 3 for inductively heating a pan or the like and an inverter circuit 4 for supplying high-frequency current to heating coil 3, and is connected to a commercial power supply 1. A control device 5 receives signals from an operation device 6, and controls inverter circuit 4 so that heating power corresponding to eight stages of "WEAK" to "STRONG" is applied to the pan. A timer period indicator 7 indicates a timer period or a remaining time, and is formed of LEDs or LCD. A heating power indicator 8 is formed of LEDs. Operation device 6 includes a timer period indicator 7, a heating power indicator 8, a down key 9, an up key 10, a heating off/on key 11, a timer key 12, and a timer cancel key 13.

The operation of the heating cooker will be described below. First, a user pushes heating off/on key 11 in order to perform heating. Subsequently, a signal is sent from operation device 6 to control device 5 so that set heating power becomes "5". In this case, control device 5 controls inverter circuit 4, and the LEDs of heating power indicator 8 that correspond to the heating power of "WEAK" to "5" are turned on. The heating power of "WEAK", "1", "2", "3", "4", "5", "6", and "STRONG" is set to about 120 W, about 235 W, about 370 W, about 500 W, about 700 W, about 1000 W, about 1450 W, and about 2000 W, respectively. The heating power can be changed into any heating power by using down key 9 or up key 10, and heating power is indicated on heating power indicator 8 so as to correspond to the change of the heating power. When the heating is terminated, the user pushes heating off/on key 11 again.

When the user intends to automatically stop the heating by timer heating after a set time, the user sets the timer. When timer key 12 is pushed, a timer period is indicated on timer period indicator 7. Whenever timer key 12 is pushed, the timer period is increased. Accordingly, it is possible to set the timer period to 9 hours and 30 minutes to the maximum extent.

In general, when each of the keys is pushed for 0.1 second, the push of the key is perceived. However, when the key is pushed for 0.1 second or more, the push of the key is perceived as along-push. Only timer key 12 is to be operated continuously. (For example, even though a user pushes up key 10 for a long time, the heating power is increased only by one stage.) When the long-push of timer key 12 is detected, the timer period is increased at intervals of 0.2 second. The timer can be set regardless of whether the heating is performed.

The operation when the long-push of timer key 12 is continued will be described below with reference to FIG. 9. When timer key 12 is pushed (Step 200), a timer mode starts and timer period indicator 7 indicates 1 minute as a timer period (Step 201). If it is determined that timer key 12 is still continuously pushed after that (Yes) (Step 202), control device 5 determines whether the timer period is the maximum time (Step 203). If the timer period is maximal (Yes), " - - - " is set (Step 204), " - - - " is indicated (Step 207), and the flow returns to Step 202. If the timer period is not maximal in Step 203 (No), it is determined whether the timer period is " - - - " (Step 205). If the timer period is " - - - " (Yes), the flow returns to Step 201. If the timer period is not " - - - " (No), the current timer period is increased (Step 206) and timer period indicator 7 indicates the time (Step 207).

When the timer period is increased, there is little point in the difference of the set timer period of 5 or 10 minutes. The increase of the timer period in step 206 is set to an interval of 1 minute for 1 to 20 minutes, an interval of 5 minutes for 20 minutes to 1 hour, an interval of 10 minutes for 1 to 3 hours, and an interval of 30 minutes for 3 hours to 9 hours and 30 minutes.

When the above-mentioned flow is repeated, the indication shown in FIG. 10 is indicated on timer period indicator 7. However, according to the above-mentioned heating cooker in the conventional art, when the timer key is the long-push state due to the failure or malfunction of the timer key, the indication of the set timer period is repeated from zero to the maximum time of a settable time, that is, 9 hours and 30 minutes. Alternatively, the set timer period is changed into an undesired time.

In a case where the timer key is not a mechanical switch but an electrostatic capacity type touch key, the timer key may be in the long-push state when a switch unit is smeared with water or foreign substances.

DISCLOSURE OF THE INVENTION

A heating cooker includes a heating device, a timer key that is used to set a timer period, and a timer period indicator that indicates the timer period or a remaining time. The timer period is increased at regular intervals or at intervals changed according to need in stages by a long-push of the timer key. When the increased time of the timer period reaches an increase-stopping-time during the long-push of the timer key, the increase of the timer period is stopped once.

According to the heating cooker, even though the timer key is in the long-push state, the timer period is only increased up to the increase-stopping-time. Therefore, it is possible to prevent the indication of the timer period from being repeated and to prevent the timer from being carelessly set to a long period.

A heating cooker includes a heating device, a timer key that is used to set a timer period, a timer period indicator that indicates the timer period or a remaining time, and a long-push timing device. The timer period is increased at regular intervals or at intervals changed according to need in stages by the long-push of the timer key. When a time counted by the long-push timing device exceeds a set time, the input of the timer key becomes ineffective and a timer mode is terminated. The set time is, for example, 1 minute.

According to the heating cooker, if the continuous long-push time of the timer key is equal to or exceeds a time for giving a person pain, it can be determined that a fault occurs in the timer key. When it is determined that a fault occurs in the timer key, the timer period becomes ineffective, so that it is possible to prevent the indication of the timer period from being repeated and to prevent the timer from being carelessly set to a long period.

DESCRIPTION OF REFERENCE NUMERALS AND SIGNS

Figure 1A:
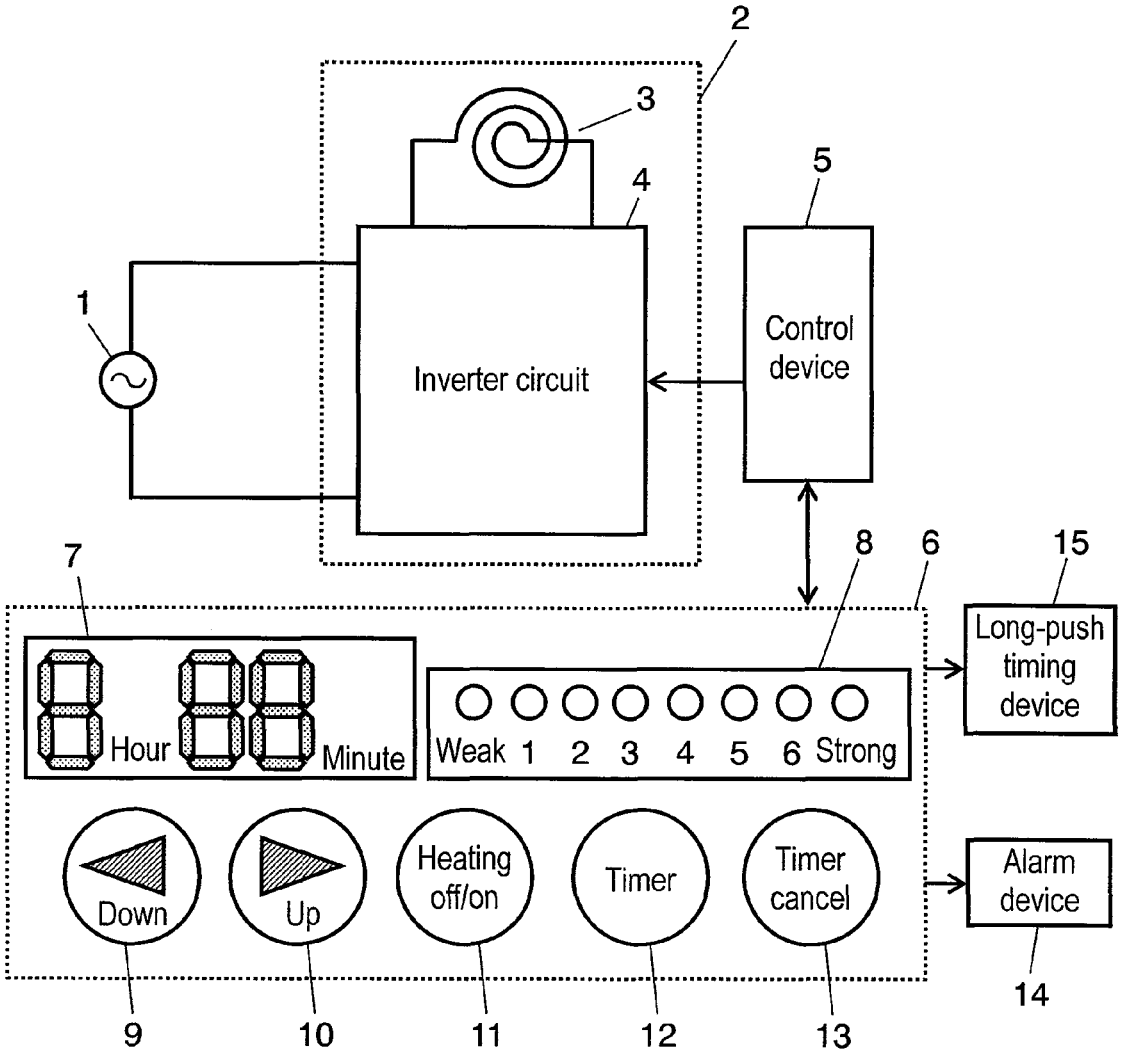
FIG. 1A is a block diagram showing the structure of a heating cooker according to a first embodiment of the present invention.

1 commercial power supply
2 heating device
3 heating coil
5 control device
6 operation device
7 timer period indicator
8 heating power indicator
12 timer key
14 alarm device
15 long-push timing device
T1 increase-stopping-time

PREFERRED EMBODIMENTS FOR CARRYING OUT THE INVENTION

Preferred embodiments of the present invention will be described below with reference to accompanying drawings. In addition, the present invention is not limited to the embodiments.

First Embodiment

Figure 1B:
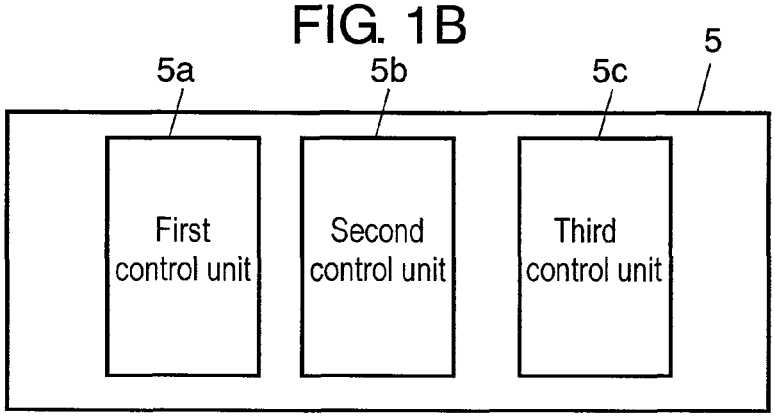
FIG. 1B is a block diagram showing the structure of a control device of the heating cooker according to the first embodiment of the present invention.

FIG. 1A is a block diagram showing the structure of a heating cooker according to a first embodiment of the present invention. FIG. 1B is a block diagram showing the structure of a control device of the first embodiment of the present invention. In FIG. 1A, a heating device 2 includes a heating coil 3 for inductively heating a pan or the like and an inverter circuit 4 for supplying high-frequency current to heating coil 3, and is connected to a commercial power supply 1. A control device 5 receives signals from an operation device 6, and controls inverter circuit 4 so that heating power corresponding to eight stages of "WEAK" to "STRONG" is applied to the pan. A timer period indicator 7 indicates a timer period or a remaining time, and is formed of LEDs or LCD. A heating power indicator 8 is formed of LEDs. The timer period is a time set by a user, and the remaining time is a time remaining until the timer period becomes 0. Operation device 6 includes a timer period indicator 7, a heating power indicator 8, a down key 9, an up key 10, a heating off/on key 11, a timer key 12, and a timer cancel key 13. An alarm device 14 is formed of a buzzer or the like, and sounds at the time of the reception of each of the keys or the alarm annunciation time of fault. A long-push timing device 15 counts a time when timer key 12 is pushed. Control device 5 further includes a first control unit 5*a*, a second control unit 5*b*, and a third control unit 5*c*. First control unit 5*a* increases a timer period at regular intervals or increases the timer period at intervals changed according to need, in stages. Second control unit 5*b* stops the increase of the timer period, and third control unit 5*c* terminates a timer mode.

The operation of the heating cooker having the above-mentioned structure will be described below.

First, a user pushes heating off/on key 11 in order to perform heating. Subsequently, a signal is sent from operation device 6 to control device 5 so that set heating power becomes "5". In this case, control device 5 controls inverter circuit 4, and the LEDs of heating power indicator 8 that correspond to the heating power of "WEAK" to "5" are turned on. The heating power of "WEAK", 1, 2, 3, 4, 5, 6, and "STRONG" is set to about 120 W, about 235 W, about 370 W, about 500 W, about 700 W, about 1000 W, about 1450 W, and about 2000 W, respectively. The heating power can be changed into any heating power by using down key 9 or up key 10, and heating power is indicated on heating power indicator 8 so as to correspond to the change of the heating power. When the heating is terminated, a user pushes heating off/on key 11 again.

In the heating cooker, for example, 45 minutes is set as a threshold time for preventing forgetting of heating-off. Accordingly, the heating cooker has a function to stop the heating as a function to remind a user to stop the heating if there is no operation for 45 minutes. When the user intends to automatically stop the heating by timer heating after a set time, the user can set the timer. When timer key 12 is pushed, a timer period is indicated on timer period indicator 7. Further, whenever timer key 12 is pushed, the timer period is increased. Accordingly, it is possible to set the timer period to 9 hours and 30 minutes to the maximum extent. In general, when each of the keys is pushed for 0.1 second, the push of the key is perceived. However, when the key is pushed for 0.1 second or more, the push of the key is perceived as a long-push. Only timer key 12 is to be operated continuously. For example, even though up key 10 is pushed for a long time, the heating power is increased only by one stage. When the long-push of timer key 12 is detected, the timer period is increased at predetermined intervals, that is, at intervals of 0.2 second. The intervals of 0.2 second may be changed on the way.

When the timer period is increased, there is little point in the difference of the set timer period of 5 or 10 minutes. The increase step of the timer period is set to an interval of 1 minute for 1 to 20 minutes, an interval of 5 minutes for 20 minutes to 1 hour, an interval of 10 minutes for 1 to 3 hours, and an interval of 30 minutes for 3 hours to 9 hours and 30 minutes. The timer may be set regardless of whether the heating is performed.

The operation of the heating cooker when the timer key is pushed will be described with reference to FIGS. 2 to 6. FIG. 2 and FIGS. 4 to 6 are flowchart illustrating the operation when the long-push of the timer key is continued. FIG. 3 is a view showing indication examples of the timer period indicator.

Figure 2:
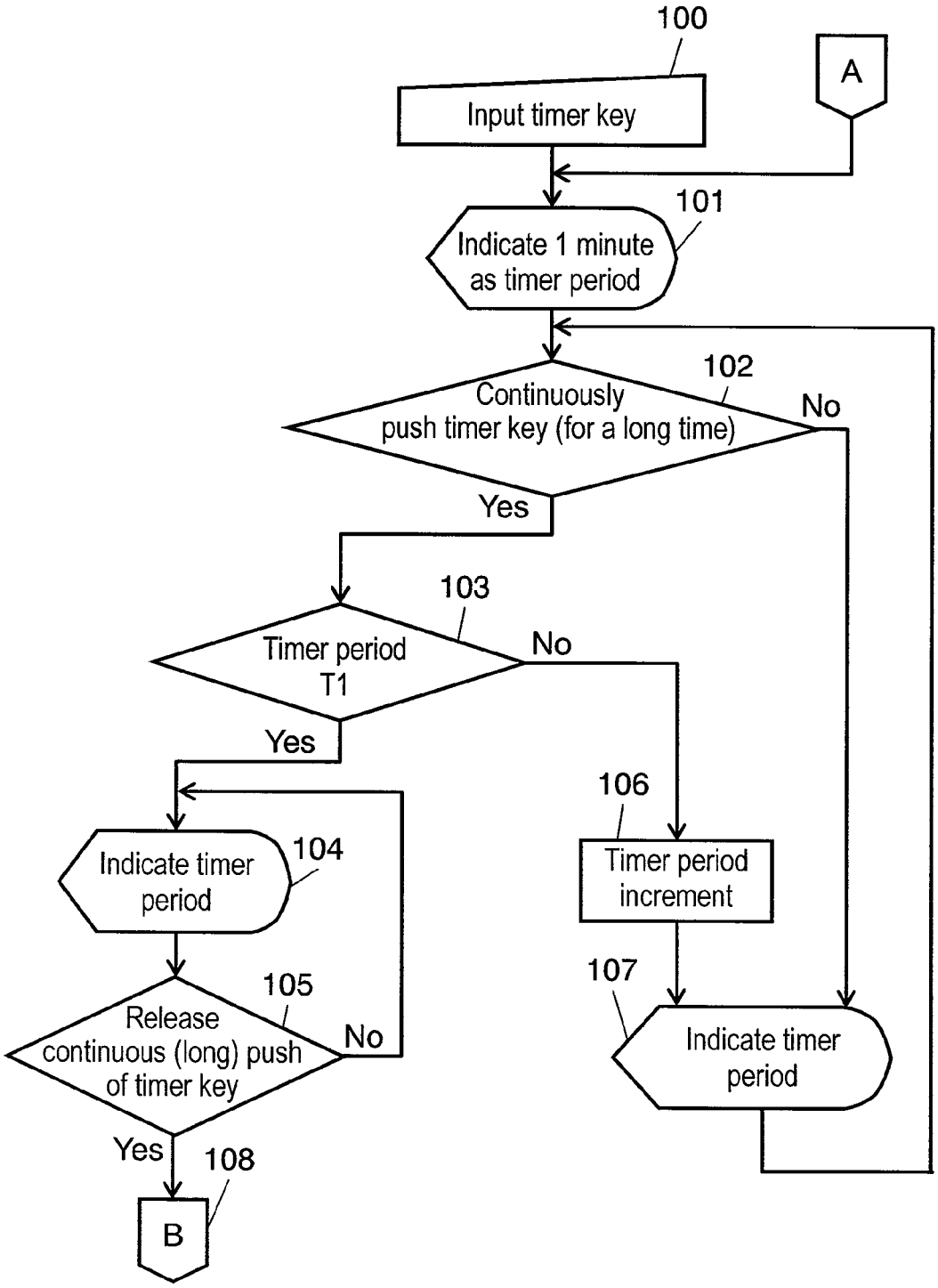
FIG. 2 is a flowchart illustrating the operation when the long-push of a timer key of the first embodiment of the present invention is continued.
Figure 3:
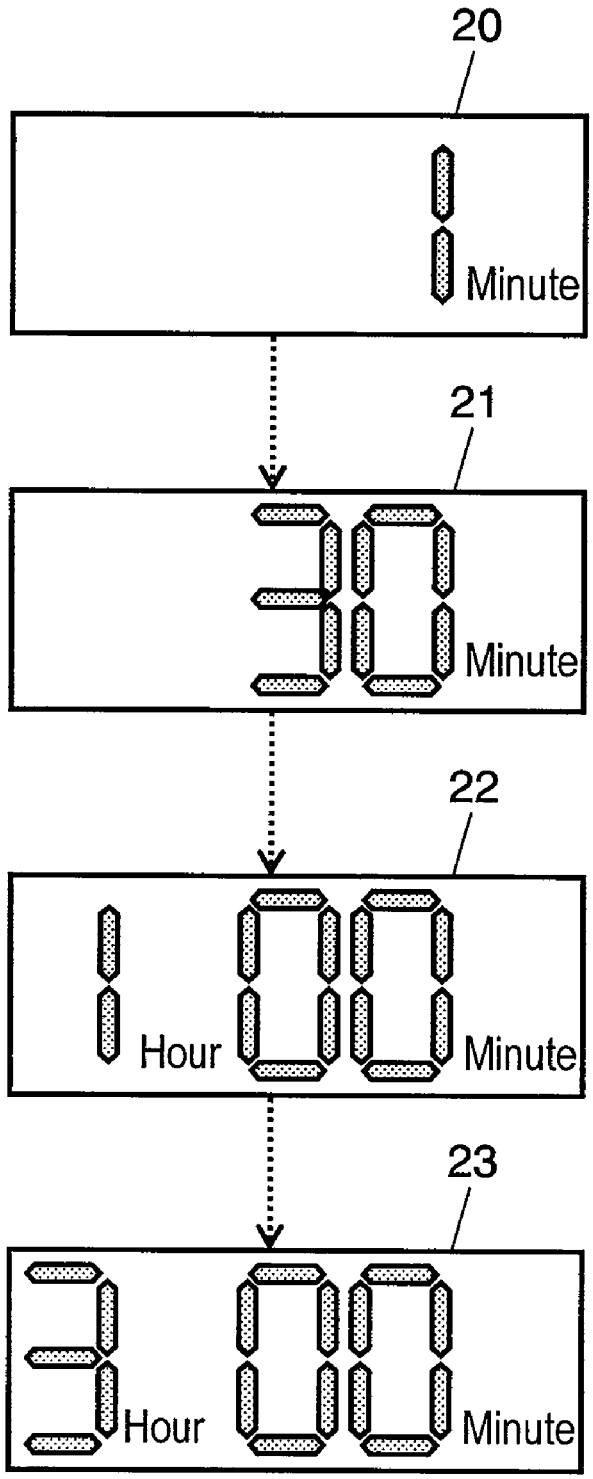
FIG. 3 is a view showing indication examples of a timer period indicator of the first embodiment of the present invention.

In FIG. 2, when the timer key is pushed (Step 100), a timer mode starts and timer period indicator 7 indicates 1 minute as a timer period (Step 101). If it is determined that timer key 12 is still continuously pushed after that (Yes) (Step 102), control device 5 determines whether the timer period is a time T1 (Step 103). In this case, time T1 is 3 hours. If the timer period is not time T1 (No), the current timer period is increased (Step 106) and timer period indicator 7 indicates the increased timer period (Step 107). The increase step of the timer period in Step 106 is set to an interval of 1 minute for 1 to 20 minutes, an interval of 5 minutes for 20 minutes to 1 hour, and an interval of 10 minutes for 1 to 3 hours. Then, the flow returns to Step 102. If the timer period is time T1 in Step 103 (Yes), timer period T1 is indicated (Step 104). After that, it is determined whether the long-push of timer key 12 is released (Yes) (Step 105). If the long-push of the timer key is not released (No), the flow returns to Step 104.

Even though the timer key 12 is in a long-push state, the indication of timer period indicator 7 is stopped at 3 hours as shown in FIG. 3 due to the above-mentioned flow. That is, even though the timer key is in the long-push state, the timer period is only increased up to an increase-stopping-time T1. Therefore, it is possible to prevent the indication of the timer period from being repeated and to prevent the timer from being carelessly set to a long period.

Figure 4:
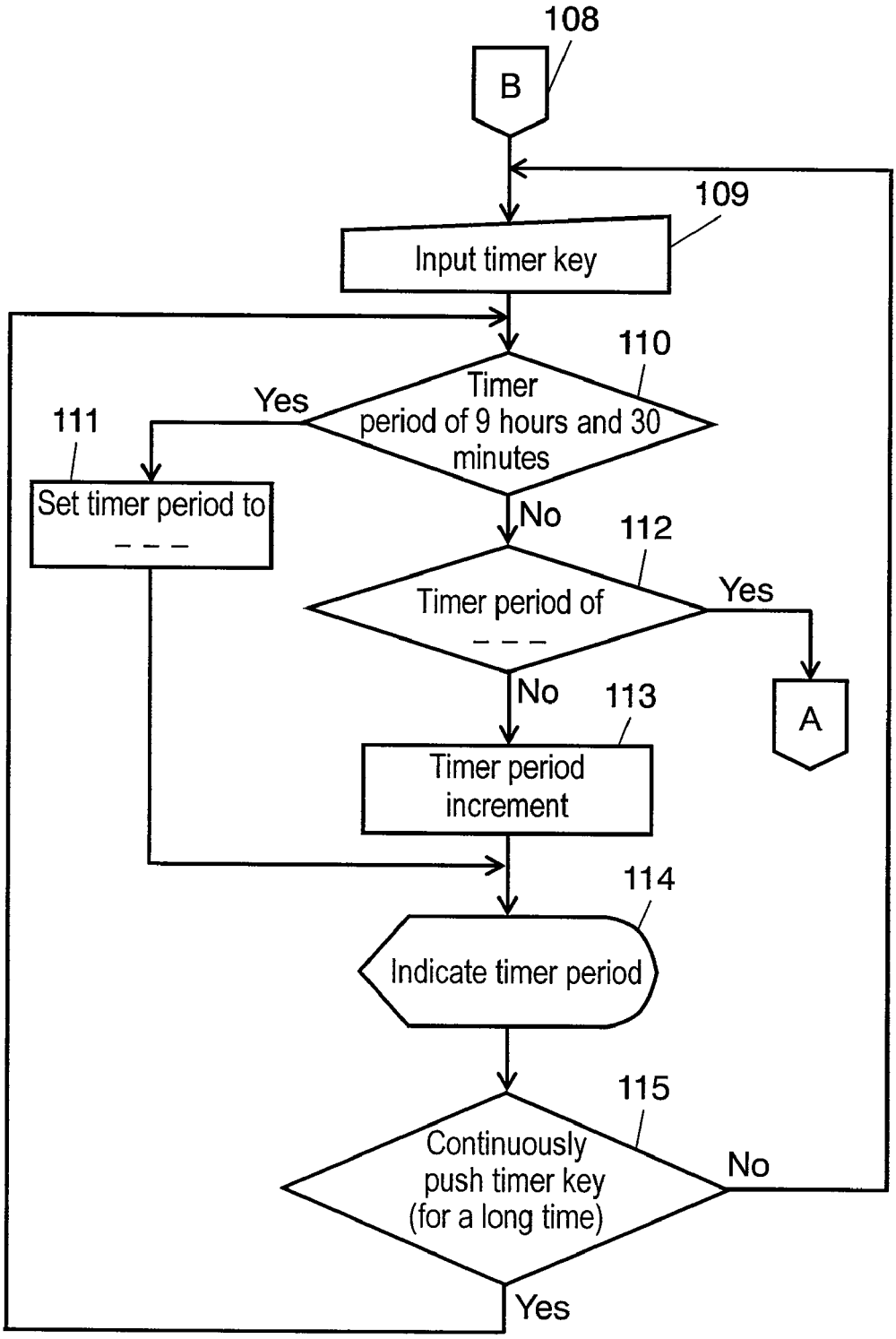
FIG. 4 is a flowchart illustrating the operation when the long-push of the timer key of the first embodiment of the present invention is continued.
Figure 5:
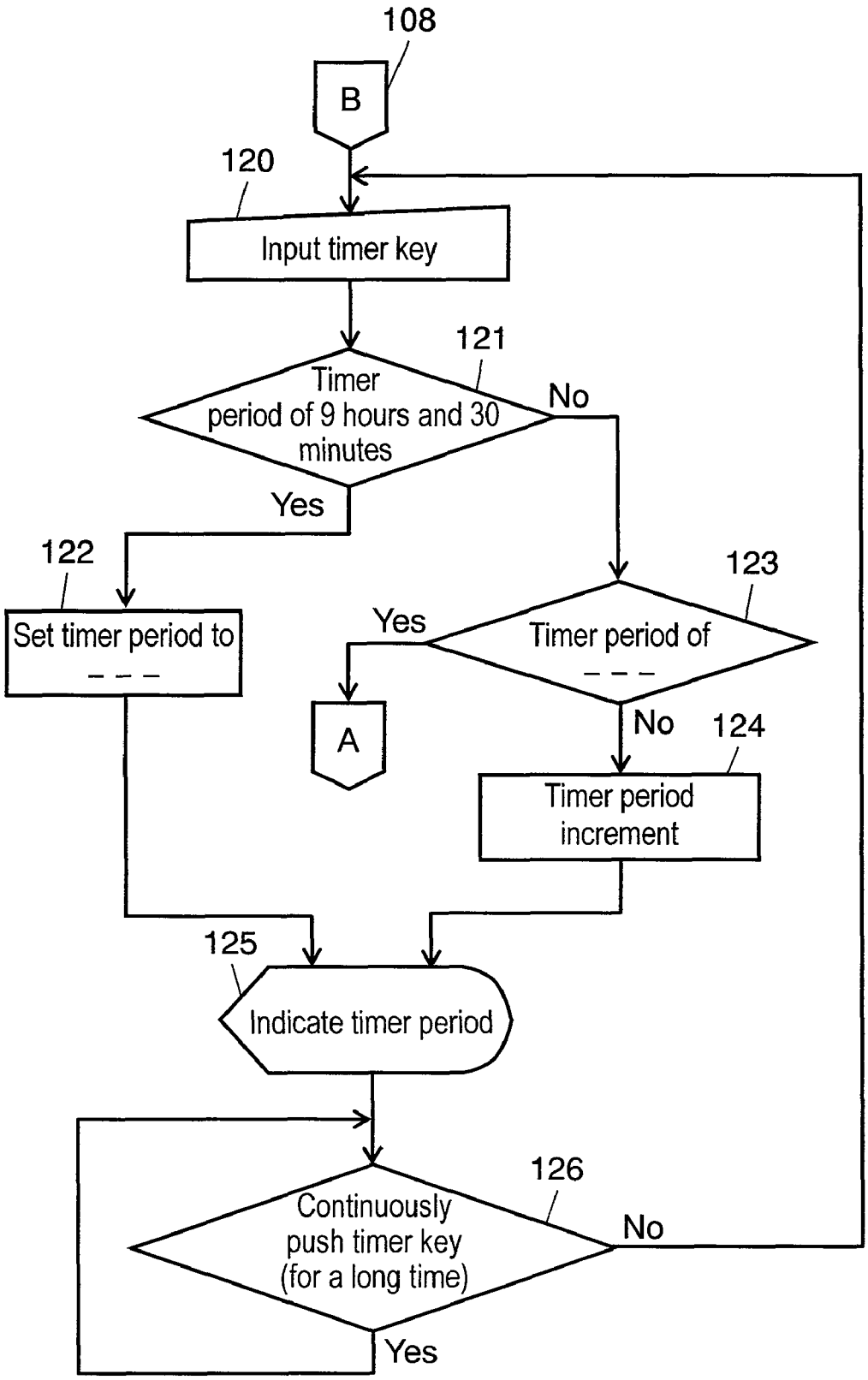
FIG. 5 is a flowchart illustrating the operation when the long-push of the timer key of the first embodiment of the present invention is continued.

If the long-push of timer key 12 is released in Step 105 (Yes), the flow proceeds to B of FIG. 4 (Step 108). Until timer key 12 is pushed, the flow is stopped while timer period T1 is indicated. After that, if timer key 12 is pushed (Step 109), control device 5 determines whether the timer period is the maximum time (Step 110). If the timer period is maximal (Yes), " - - - " is set (Step 111), " - - - " is indicated (Step 114), and it is determined whether timer key 12 is pushed for a long time (Step 115). If the timer key is pushed for a long time (Yes), the flow returns to Step 110. If the timer key is not pushed for a long time (No), the flow returns to Step 109.

If the timer period is not maximal in Step 110 (No), control device 5 again determines whether the timer period is " - - - " (Step 112). If the timer period is " - - -" (Yes), the flow returns to A of FIG. 2. If the timer period is not " - - - " (No), the current timer period is increased (Step 113) and the increased timer period is indicated (Step 114). In this case, the increase step of the time period in Step 113 is set to an interval of 30 minutes. After that, the flow proceeds to Step 115.

As described above, in this embodiment, when the long-push of the timer key is continued, the increased of the timer period is stopped once if the timer period reaches increase-stopping-time T1. Accordingly, even though timer key 12 is in the long-push state, the indication of timer period indicator 7 is stopped at 3 hours as shown in FIG. 2. After that, if the long-push of the timer key is not released once, it is possible to allow the time not to increase. The reason why increase-stopping-time T1 is set to 3 hours in this case is that the heating performed by setting the timer is generally within 3 hours. The step size of the set timer period becomes an interval of 30 minutes over 3 hours. Accordingly, even when a user intends to set the timer period to a value exceeding 3 hours, a user should separate his/her finger from timer key 12 once, which is to prevent the mistake from occurring in setting the timer period.

For this reason, even when the timer key is in the long-push state, the timer period is only increased up to an increase-stopping-time T1. Therefore, it is possible to prevent the indication of the timer period from being repeated and to prevent the timer from being carelessly set to a long period.

Increase-stopping-time T1 is changed depending on the heating power. For example, when the heating power is set to "WEAK" to "4", the increase-stopping-time is set to 6 hours. When the heating power is set to "5" or "6", the increase-stopping-time is set to 3 hours. When the heating power is set to "STRONG", the increase-stopping-time is set to 1 hour. When the heating power is high, increase-stopping-time T1 is set to be short. Accordingly, boiling performed using low heating power, which is generally used in a timer cooking, is continuously performed until a long time is set. Therefore, it is possible to prevent the indication of the timer period from being repeated and to prevent the timer from being carelessly set to a long period.

When the timer period is set to a time exceeding increase-stopping-time T1, the long-push of the timer key becomes ineffective. A specific flow will be described with reference to FIG. 5.

In this case, the flow is the same as that shown in FIG. 2 until proceeding to B of Step 108. When timer key 12 is pushed (Step 120), control device 5 determines whether the timer period is the maximum time (Step 121). If the timer period is maximal (Yes), " - - - " is set (Step 122) and " - - - " is indicated (Step 125). Then, it is determined whether the timer key 12 is pushed for a long time (Step 126). If the timer key is pushed for a long time (Yes), Step 126 is repeated. If the timer key is not pushed for a long time (No), the flow returns to Step 120. If the timer period is not maximal in Step 121 (No), it is determined whether the timer period is " - - - " (Step 123). If the timer period is " - - - " (Yes), the flow returns to A of FIG. 2. If the timer period is not " - - - " (No), the current timer period is increased (Step 124) and timer period indicator 7 indicates the increased timer period (Step 125). In this case, the increase of the time period in Step 124 is performed according to the step size of the set timer period. Subsequently, the flow proceeds to Step 126.

In this way, the increase of the timer period is stopped at increase-stopping-time T1 once. After that, even though the timer key is again in the long-push state due to any fault, it is possible to prevent the indication of the timer period from being repeated and to prevent the timer from being carelessly set to a long period.

Figure 6:
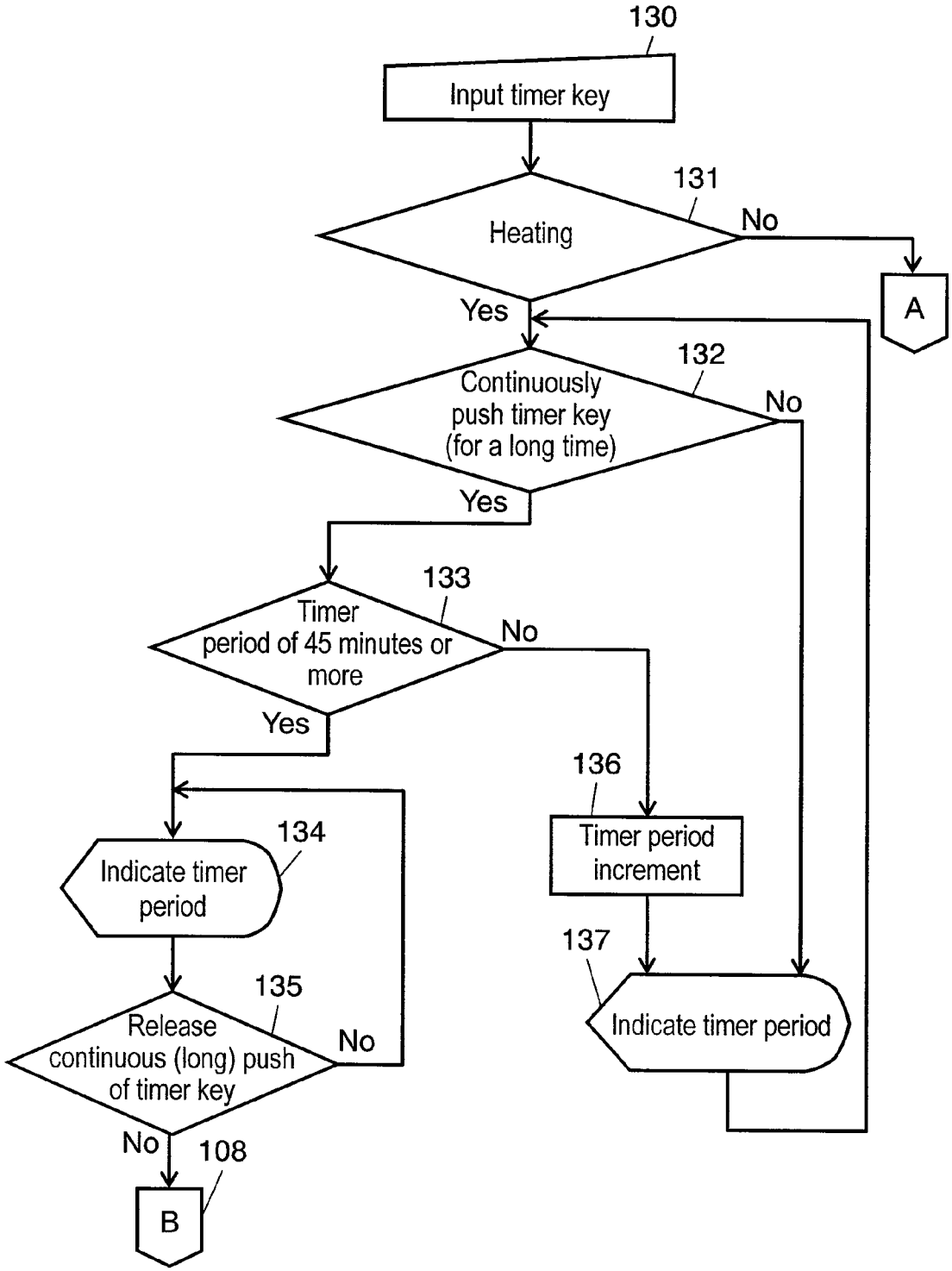
FIG. 6 is a flowchart illustrating the operation when the long-push of the timer key of the first embodiment of the present invention is continued.

As shown in FIG. 6, when the timer is set during the heating or when the timer period is changed during the heating, increase-stopping-time T1 is set to 45 minutes that is the heating-off reminding time. When a set timer period is set to 45 minutes or more and the heating is performed, the change of the timer period is unavailable. For this reason, even though timer key 12 is in the long-push state due to the fault occurring in timer key 12 after the heating, the time change is limited up to the heating-off reminding time after the beginning of a cooking. Accordingly, it is possible to ensure the same performance as a general safety function.

When the increase of the timer period is stopped at the increase-stopping-time due to the long-push of timer key 12, alarm device 14 gives the alarm. Accordingly, when a user continuously pushes timer key 12 to set the timer period, it is possible to let the user know why the increase of the time is stopped. Even though the user stands away from the device, it is possible to let the user know that a fault occurs in the device.

Although one timer key has been used in this embodiment, hour and minute may be set in the timer by independent keys. Although an induction heating type heating device has been used, a heat source such as gas or sheath heater may be used. Each of the keys has generally switch structure. However, even though electrostatic capacity detection type touch keys are used, it is possible to obtain the same effect.

Second Embodiment

Figure 7:
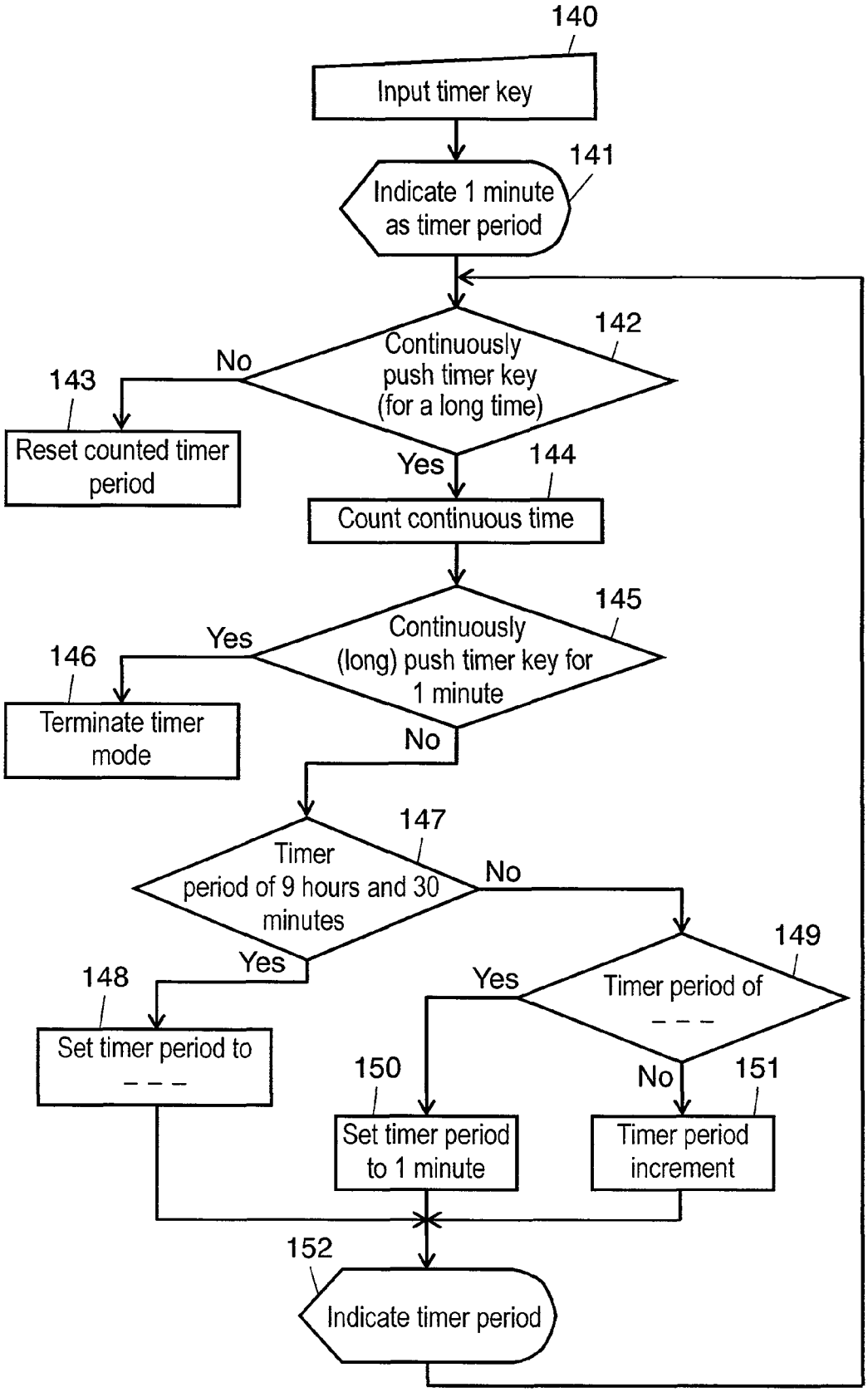
FIG. 7 is a flowchart illustrating the operation when the long-push of a timer key of a second embodiment of the present invention is continued.
Figure 8:
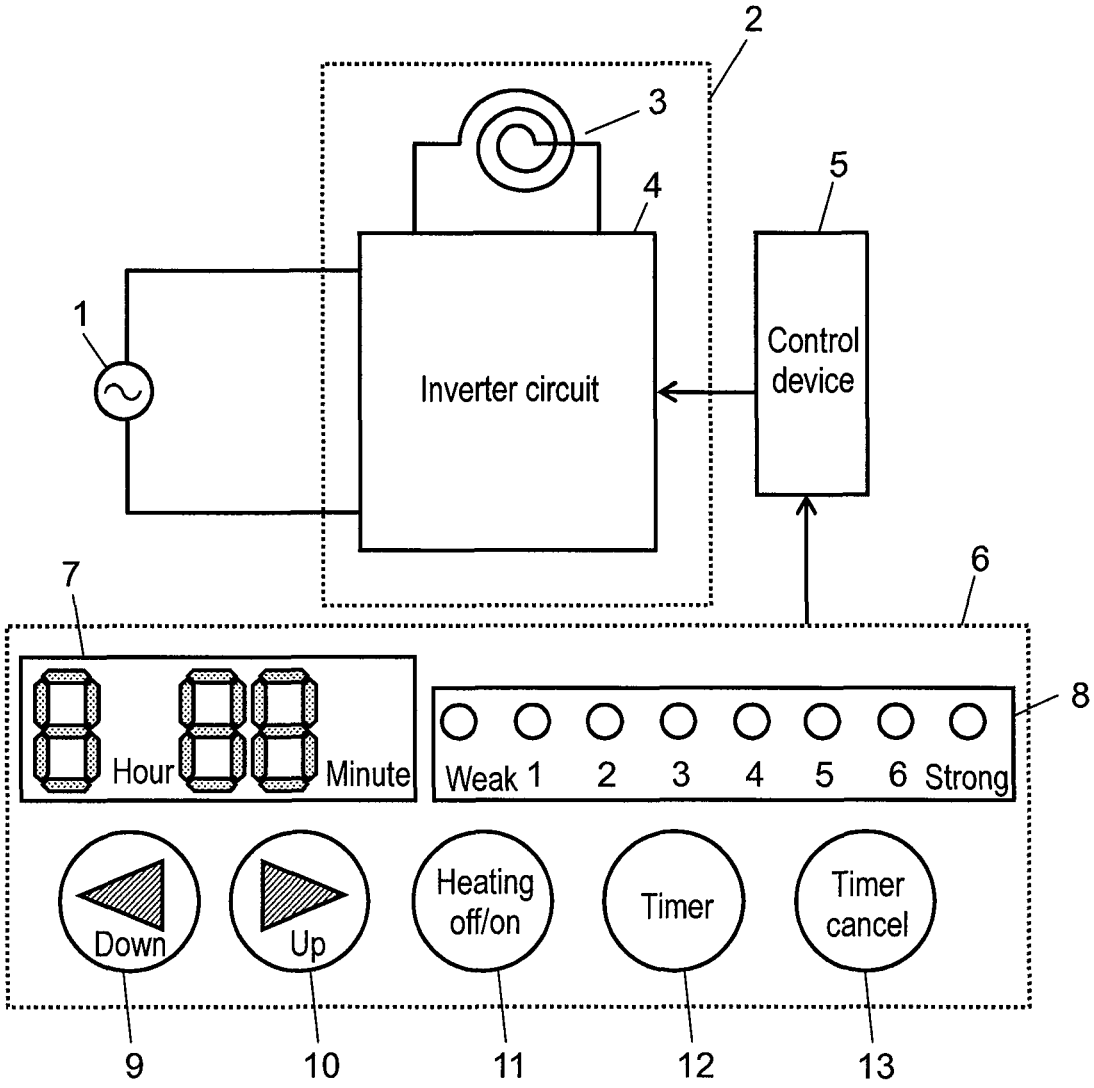
FIG. 8 PRIOR ART
FIG. 8 is a block diagram showing the structure of a heating cooker in the conventional art.
Figure 9:
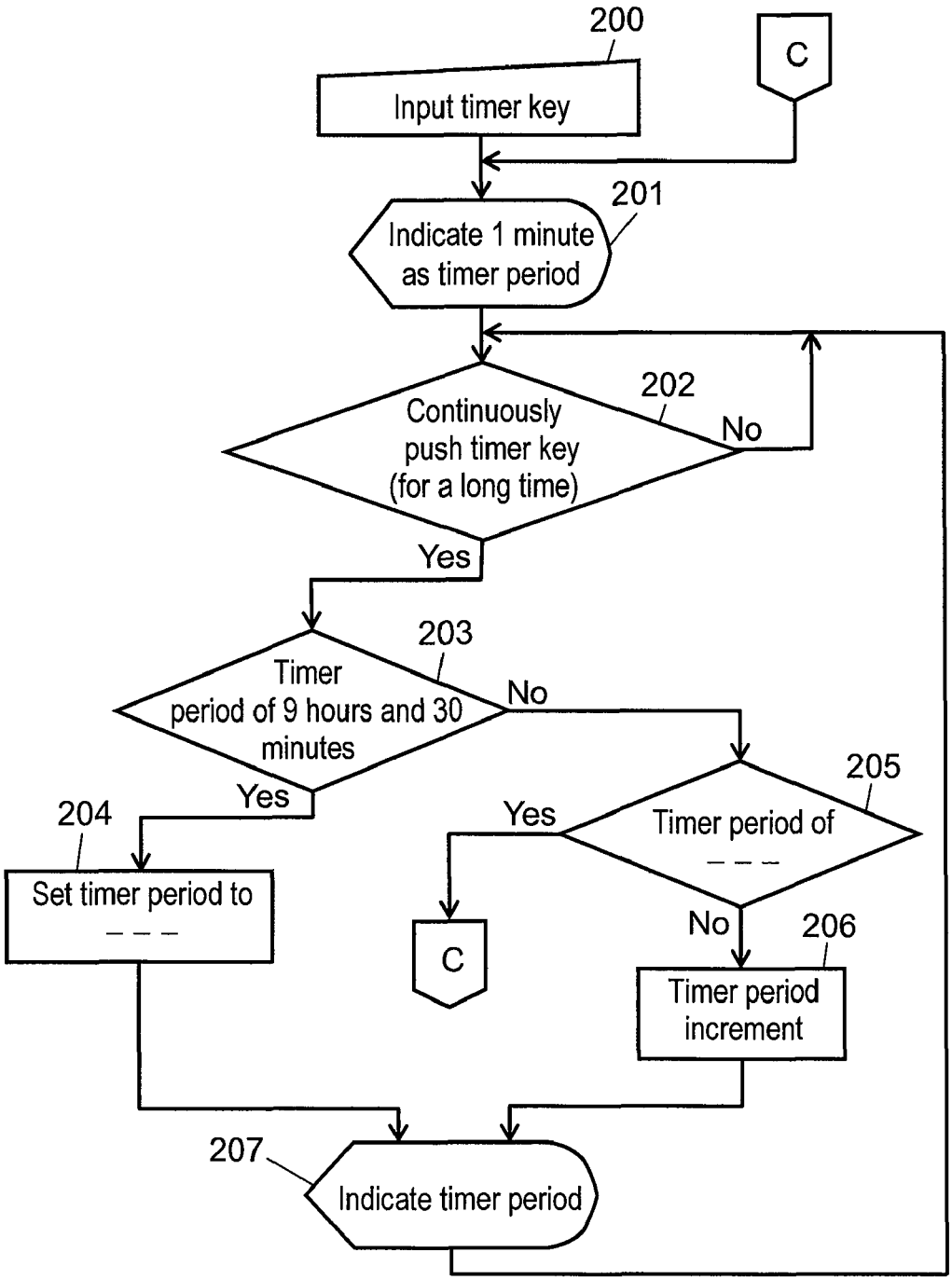
FIG. 9 PRIOR ART
FIG. 9 is a flowchart illustrating the operation when the long-push of a timer key in the conventional art is continued.
Figure 10:
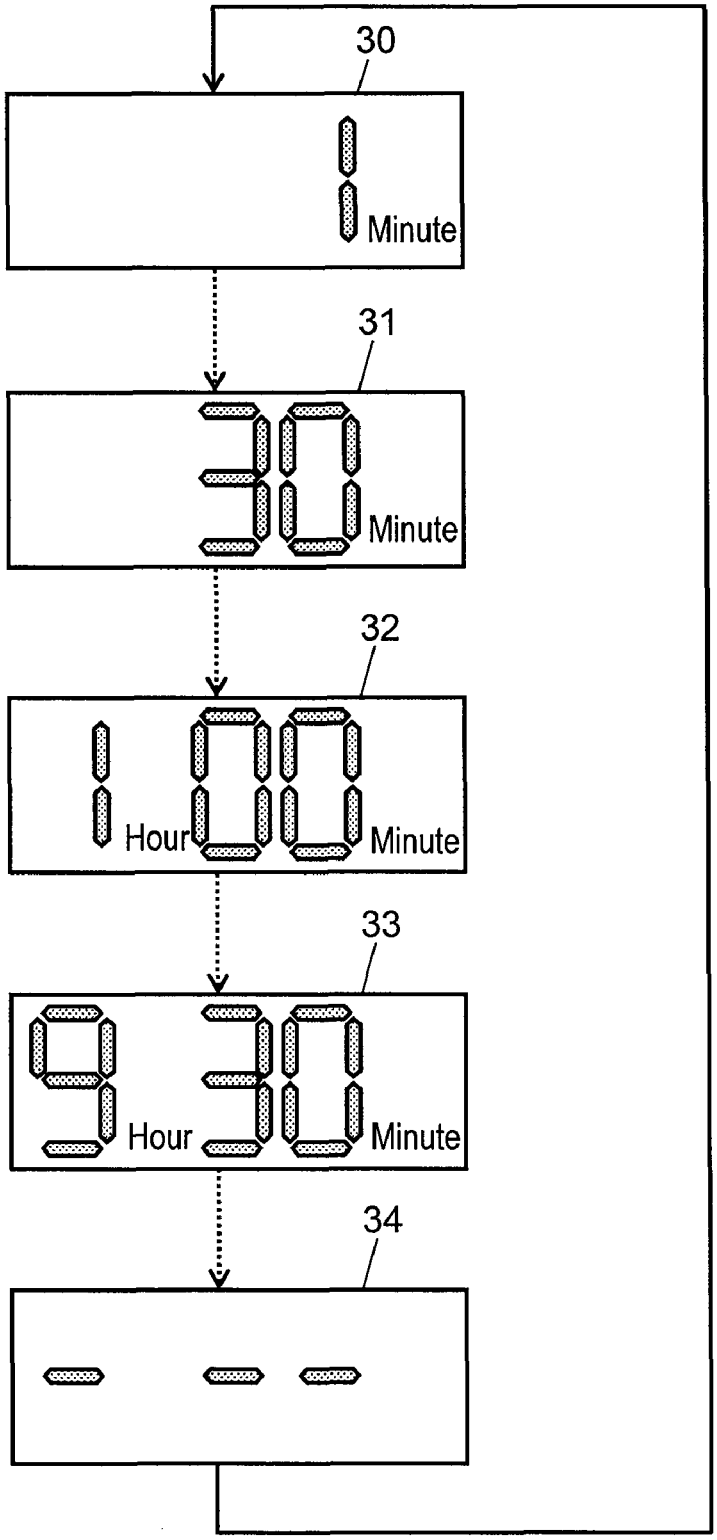
FIG. 10 PRIOR ART
FIG. 10 is a view showing indication examples of a timer period indicator in the conventional art.

A second embodiment of the present invention will be described with reference to FIG. 7. Since block diagrams showing the structure of a heating cooker are the same as FIGS. 1A and 1B, the descriptions thereof will be omitted. FIG. 7 is a flowchart illustrating the operation when the long-push of a timer key of a second embodiment of the present invention is continued.

When a timer key is pushed (Step 140), a timer mode starts and a timer period indicator 7 indicates 1 minute as a timer period (Step 141). After that, it is determined whether timer key 12 is continuously pushed (Step 142). If timer key 12 is continuously pushed (Yes), a long-push timing device counts a continuous push time (Step 144) and it is determined whether the continuous push of the timer key is performed for 1 minutes (Step 145). If the timer key is continuously pushed for less than 1 minute (No), the flow proceeds to Step 147 and a control device 5 determines whether the timer period is 9 hours and 30 minutes that is the maximum time. If the timer period is maximal (Yes), " - - - " is set (Step 148), timer period indicator 7 indicates " - - - " (Step 152), and the flow returns to Step 142. If the timer period is not the maximum time in Step 147 (No), control device 5 determines whether the timer period is (Step 149). If the timer period is " - - -" (Yes), the timer period is set to 1 minute (Step 150) and 1 minute is indicated (Step 152). If the timer period is not " - - - " (No), the current timer period is increased (Step 151) and the increased timer period is indicated (Step 152). In this case, the increase of the time period in Step 151 is performed according to the step size of the set timer period. After the timer period is indicated in Step 152, the flow returns to Step 142.

If it is determined in Step 142 that the long-push of timer key 12 is not continued (No), the counted time is reset (Step 143). When the continuous push of timer key 12 is performed for 1 minute or more in Step 145 (Yes), the flow proceeds to Step 146, the input of timer key 12 becomes ineffective, and the timer mode is terminated.

Although the continuous long-push time has been 1 minute in this embodiment, control device 5 may determine a fault of the timer key if the continuous long-push time of the timer key is equal to or exceeds a time for giving a person pain. When it is determined that a fault occurs in the timer key, the timer becomes ineffective, so that it is possible to prevent the indication of the timer period from being repeated and to prevent the timer from being carelessly set to a long period.

When it is detected that the continuous push of timer key 12 is performed for 1 minute or more during the heating, control device 14 may stop the heating. For this reason, it is possible to prevent the timer heating from being carelessly performed for a long time due to the fault of the timer key, thereby improving the safety during the occurrence of a fault.

When the long-push of the timer key is stopped, the counted time is reset in Step 143. For this reason, since it is possible to prevent the timer period from becoming ineffective due to the fact that a time accumulated by the long-push of timer key 12 reaches a set time, operability does not deteriorate. One minute is set as the set time in this embodiment.

When the long-push of timer key 12 is continued for 1 minute, alarm device 14 may give the alarm. Accordingly, when the timer key is continuously pushed in order to set the timer period, it is possible to give the alarm if the timer period exceeds 1 minute by mistake and the timer thus becomes ineffective. Even when the heating is stopped or even when the long-push state is continued for 1 minute due to a fault occurring in the timer key, it is possible to give the alarm.

Although one timer key has been used in this embodiment, hour and minute may be set in the timer by independent keys. Although an induction heating type heating device has been used, a heat source such as gas or sheath heater may be used. Each of the keys has generally switch structure. However, even though electrostatic capacity detection type touch keys are used, it is possible to obtain the same effect.

INDUSTRIAL APPLICABILITY

When the long-push state is continued due to the fault of the timer key, the heating cooker according to the present invention can prevent the indication of the timer period from being repeated and prevent the timer from being carelessly set to a long period. The present invention can be applied to devices having a timer function according to the same operation method, such as a range, a jar rice cooker, a jar pot, an IH cooker, a hot plate, a gas cooker, a home bakery, and toaster.

The invention claimed is:

1. A heating cooker comprising:

a heating device;

a timer key for setting a timer period; and a timer period indicator that indicates the timer period or a remaining time, wherein the timer period is repeatedly increased in set time increments, while the timer key is continuously pushed, and when the timer period reaches an increase-stopping-time, while the timer key is being continuously pushed, the repeated increase of the timer period is stopped, the increase-stopping-time being exceeded by releasing and then pushing the timer key again.

2. The heating cooker of claim 1, wherein when the timer key is continuously pushed for a set period time, the timer key becomes disabled.

3. The heating cooker of claim 1, wherein when the heating cooker is not operated, a heating-off reminding time is set to a threshold time that stops the heating of heating cooker, and the increase-stopping-time is set to the heating-off reminding time during the heating.

4. The heating cooker of claim 1, further comprising:

an alarm device, wherein when the increase of the timer period is stopped at the increase-stopping-time when the timer key is continuously pushed, the alarm device gives an alarm.

5. The heating cooker of claim 1, further comprising:

a control device, wherein the control device includes a first control unit and a second control unit, the first control unit increases the timer period in stages when the timer key is continuously depressed, and when the increased time of the timer period reaches the increase-stopping-time during while being continuously depressed, the second control unit stops the increase of the timer period once.

6. The heating cooker of claim 1, wherein the heating cooker has multistage heating power, and the increase-stopping-time is changed at each stage of the multistage heating power.

7. A heating cooker comprising:

a heating device;

a timer key for setting a timer period;

a timer period indicator that indicates the timer period or a remaining time; and a long-push timing device for counting a time in which the timer key is continuously depressed, wherein the timer period is repeatedly increased in set time increments while the timer key is continuously depressed, and when the time counted by the long-push timing device exceeds a set time, the timer key becomes disabled and a timer mode is terminated.

8. The heating cooker of claim 7, wherein continuously depressing the timer key causes heating to be stopped over the set time.

9. The heating cooker of claim 7, further comprising:

an alarm device, wherein when the time counted by the long-push timing device reaches the set time, the alarm device gives the alarm.

10. The heating cooker of claim 7, further comprising:

a control device, wherein the control device includes a first control unit and a third control unit, the first control unit increases the timer period in stages when the timer key is continuously depressed, and when the time counted by the long-push timing device exceeds the set time, the third control unit makes the input of the timer key ineffective and terminates the timer mode.

* * * * *